US012582154B2

(12) United States Patent
Choe et al.

(10) Patent No.: US 12,582,154 B2
(45) Date of Patent: Mar. 24, 2026

(54) ELECTRICALLY HEATED SMOKING ARTICLE

(71) Applicant: EM-TECH Co., Ltd., Gyeongsangnam-do (KR)

(72) Inventors: Hwan Ock Choe, Gyeongsangnam-do (KR); Ji Hye Jang, Busan (KR)

(73) Assignee: EM-TECH Co., Ltd., Gyeongsangnam-do (KR)

( * ) Notice: Subject to any disclaimer, the term of this patent is extended or adjusted under 35 U.S.C. 154(b) by 507 days.

(21) Appl. No.: 18/114,574

(22) Filed: Feb. 27, 2023

(65) Prior Publication Data

US 2024/0016200 A1 Jan. 18, 2024

(30) Foreign Application Priority Data

Jul. 14, 2022 (KR) ..... 10-2022-0086903

(51) Int. Cl.

| | |
|---|---|
| ***A24B 15/28*** | (2006.01) |
| ***A24B 15/167*** | (2020.01) |
| ***A24B 15/30*** | (2006.01) |
| ***A24B 15/32*** | (2006.01) |
| ***A24B 15/40*** | (2006.01) |
| ***A24D 1/20*** | (2020.01) |

(52) U.S. Cl.

CPC ..... *A24B 15/283* (2013.01); *A24B 15/167* (2016.11); *A24B 15/285* (2013.01); *A24B 15/302* (2013.01); *A24B 15/32* (2013.01); *A24B 15/406* (2013.01); *A24D 1/20* (2020.01)

(58) Field of Classification Search

None

See application file for complete search history.

(56) References Cited

U.S. PATENT DOCUMENTS

2011/0104218 A1* 5/2011 Karles ..... B01J 13/22 424/463

2011/0155151 A1 6/2011 Newman et al.

(Continued)

FOREIGN PATENT DOCUMENTS

CN 113017129 A 6/2021

CN 111713736 B 5/2022

(Continued)

OTHER PUBLICATIONS

CN113017129A English Translation obtained from Espacenet, pp. 1-36 (Year: 2021).*

*Primary Examiner* — Philip Y Louie

*Assistant Examiner* — Madeleine P Delacruz

(74) *Attorney, Agent, or Firm* — Murphy, Bilak & Homiller, PLLC

(57) ABSTRACT

An electrically heated smoking article includes a filter layer, a hollow tube layer stacked at a lower end of the filter layer, an aerosol-forming substrate layer stacked below the hollow tube layer and including a mixture of a solid moisture absorbent and a liquid aerosol-forming substrate capsule, and a wrapping portion surrounding the filter layer, the hollow tube layer, and the aerosol-forming substrate layer to maintain a stack structure. The liquid aerosol-forming substrate capsule includes a liquid aerosol-forming substrate at a center, a first emulsifier layer completely surrounding the liquid aerosol-forming substrate, and a first coating material layer covering a surface of the first emulsifier layer.

9 Claims, 3 Drawing Sheets

(56) References Cited

U.S. PATENT DOCUMENTS

| | | | | |
|---|---|---|---|---|
| 2015/0296874 | A1* | 10/2015 | Awty | A24B 13/00 493/47 |
| 2021/0077394 | A1 | 3/2021 | Moaseri | |
| 2021/0244076 | A1 | 8/2021 | Ferrie et al. | |
| 2021/0337859 | A1* | 11/2021 | Cheong | A24D 3/17 |

FOREIGN PATENT DOCUMENTS

| | | | |
|---|---|---|---|
| JP | 2008546400 | A | 12/2008 |
| JP | 2021523728 | A | 9/2021 |
| JP | 2022049575 | A | 3/2022 |
| KR | 100355670 | B1 | 10/2002 |
| KR | 101466617 | B1 | 11/2014 |
| KR | 20150082608 | A | 7/2015 |
| KR | 20210070352 | A | 6/2021 |
| WO | 2010146845 | A1 | 12/2010 |

* cited by examiner

ELECTRICALLY HEATED SMOKING ARTICLE

TECHNICAL FIELD

The present disclosure relates to smoking articles, and more particularly, to an electrically heated smoking article in which a capsule accommodating a liquid aerosol-forming substrate is incorporated within a moisture absorbent in a solid form.

BACKGROUND

Combustible smoking articles, such as cigarettes, generally have a tobacco substrate of shredded tobacco (usually in the form of a cut filler) surrounded by a paper wrapper forming a tobacco rod. Cigarettes are used by smokers by lighting one end of the cigarette and burning a tobacco rod. Smokers then generally draw a mainstream smoke into their mouth by intaking through an opposite end of the cigarette including a filter or a mouth tip. Conventional cigarettes generate temperatures that burn the tobacco and discharges volatile compounds into the mainstream smoke. It is known to provide cigarettes with single and multi-segment mouthpiece filters that contain flavoring agents, such as menthol, to modify a flavor of mainstream smoke.

A number of smoking articles in which an aerosol generating substrate is heated rather than combusted, like tobacco substrates, are also known in the art. Such articles may also be referred to as aerosol-generating articles. Examples of systems using aerosol-generating articles include a system in which a tobacco-including substrate is heated above 200° C. to generate a nicotine-including aerosol. Typically, in such electrically heated smoking articles, an inhalable aerosol is generated by heat transfer from a heat source to an aerosol-forming substrate, which may be located in, around or downstream of the heat source. During consumption of the aerosol-generating article, volatile compounds are released from the aerosol-forming substrate by transfer of heat from the heat source and are entrained in the air drawn through the article. The released compounds are cooled and condensed to form an aerosol that is inhaled by the consumer.

During manufacture of these smoking articles, a tobacco substrate is typically heated or dried to remove, for example, water. During the heating or drying operation, volatile compounds, such as flavoring agents, are removed from the tobacco substrate, changing the taste of a final smoking article. Currently, flavoring agents are directly sprayed on the dried tobacco substrate, but there is a problem in that these flavoring agents are also dried or deteriorated over time.

SUMMARY

An object of the present disclosure is to provide an electrically heated smoking article in which a capsule accommodating a liquid aerosol-forming substrate is incorporated within a moisture absorbent in a solid form.

According to an aspect of the present disclosure for achieving the above objects, there is provided an electrically heated smoking article including: a filter layer; a hollow tube layer stacked at a lower end of the filter layer; an aerosol-forming substrate layer stacked below the hollow tube layer and including a mixture of a solid moisture absorbent and a liquid aerosol-forming substrate capsule; and a wrapping portion surrounding the filter layer, the hollow tube layer, and the aerosol-forming substrate layer to maintain a stack structure, wherein the liquid aerosol-forming substrate capsule includes a liquid aerosol-forming substrate at a center, a first emulsifier layer completely surrounding the liquid aerosol-forming substrate, and a first coating material layer covering a surface of the first emulsifier layer.

The liquid aerosol-forming substrate may be a hydrophilic material, the first emulsifier layer may be a hydrophobic material, and the first coating material layer may be a hydrophobic material.

The first emulsifier layer may include a first emulsifier including one or more materials selected from the group consisting of sorbitan monopalmitate, glycerol monostearate, sorbitan monostearate, sorbitan monooleate, glycerol monolaurate, propylene glycol monoester, glycerol monooleate, polyglycerol polyricinoleate, and soy lecithin.

The first coating material layer may include one or more materials selected from the group consisting of palm oil, beeswax, candelilla wax, coconut oil, cinnamon bark oil, soybean oil, hydrophobic polymers, and alcohols.

The liquid aerosol-forming substrate capsule may further include a hydrophilic second emulsifier layer surrounding the entire first coating material layer.

The second emulsifier layer may be formed of a second emulsifier including one or more materials selected from the group consisting of polyoxyethylene sorbitan monostearate, polyglycerol monooleate, polyoxyethylene sorbitan monolaurate, polyoxyethylene sorbitan monooleate, polyoxyethylene sorbitan monopalmitate, and sucrose stearate.

The liquid aerosol-forming substrate capsule may include a hydrophilic second coating material layer surrounding the entire second emulsifier layer.

The second coating material layer may be formed of one or more materials selected from the group consisting of vegetable, algae, or bacterial polysaccharide, hydrophilic protein, hydrophilic polymer, and alcohol.

The liquid aerosol-forming substrate may include one or more materials selected from the group consisting of glycerin, propylene glycol, nicotine, perfume, caffeine, water, cypress water, nutrient tonic, and cannabinoids.

The solid moisture absorbent may be a solid aerosol-forming substrate.

The electrically heated smoking article may further include: a second aerosol-forming substrate layer stacked below the hollow tube layer and including a solid aerosol-forming substrate.

In the embodiment, since the capsule accommodating a liquid aerosol-forming substrate is mixed in a solid moisture absorbent, the liquid aerosol-forming substrate may be protected in the capsule until the capsule is heated.

DETAILED DESCRIPTION

Figure 1:
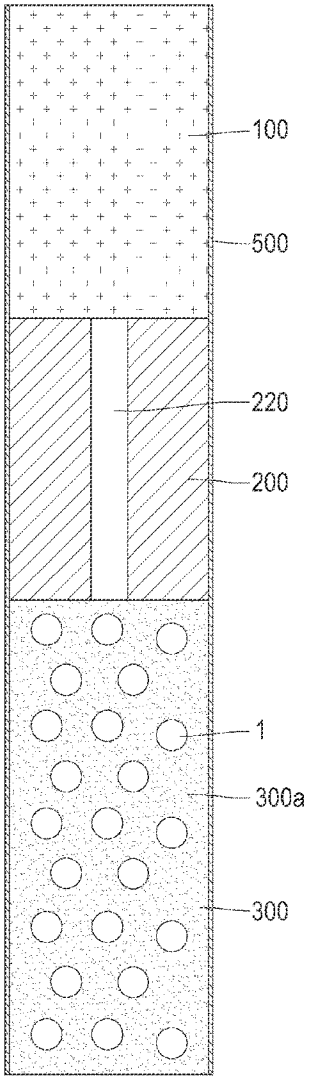
FIG. 1 is a schematic cross-sectional view of an electrically heated smoking article according to an embodiment.

Hereinafter, various embodiments of the present disclosure will be disclosed with reference to the accompanying drawings. However, it should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements.

In the present disclosure, an expression, such as "having," "may have," "comprising," or "may comprise" indicates existence of a corresponding characteristic (e.g., a numerical value, a function, an operation, or an element like a part) and does not exclude existence of additional characteristic.

As used herein, each of such phrases as "A or B," "at least one of A or/and B," "at least one or more of A or/and B," and so forth may include all possible combinations of the items enumerated together in a corresponding one of the phrases. For example, "A or B," "at least one of A and B," or "one or more of A or B" may indicate the entire of (1) including at least one A, (2) including at least one B, or (3) including both at least one A and at least one B.

Expressions, such as "first," "second," "primarily," or "secondary," used herein may represent various elements regardless of order and/or importance and do not limit corresponding elements. For example, a first user device and a second user device may represent different user devices regardless of order or importance. For example, a first element may be named as a second element without departing from the right scope of the various embodiments of the present disclosure, and similarly, a second element may be named as a first element.

When it is described that an element (such as a first element) is "operatively or communicatively coupled with/to" or "connected" to another element (such as a second element), the element may be directly connected to the other element or may be connected to the other element through another element (e.g., a third element). However, when it is described that an element (such as a first element) is "directly connected" or "directly coupled" to another element (such as a second element), it means that there is no intermediate element (such as a third element) between the element and the other element.

An expression "configured to (or set)" used in the present disclosure may be replaced with, for example, "suitable for," "having the capacity to," "designed to," "adapted to," "made to," or "capable of" according to a situation. A term "configured to (or set)" does not always mean only "specifically designed to" by hardware. Alternatively, in some situation, an expression "apparatus configured to" may mean that the apparatus "can" operate together with another apparatus or component.

Terms defined in the present disclosure are used for only describing a specific embodiment and may not have an intention to limit the scope of other embodiments. The singular forms are intended to include the plural forms as well, unless the context clearly indicates otherwise. All of the terms used herein including technical or scientific terms have the same meanings as those generally understood by an ordinary skilled person in the related art. The terms defined in a generally used dictionary should be interpreted as having meanings that are the same as or similar with the contextual meanings of the relevant technology and should not be interpreted as having ideal or exaggerated meanings unless they are clearly defined in the various embodiments. In some case, terms defined in the present disclosure cannot be analyzed to exclude the present embodiments.

FIG. 1 is a schematic cross-sectional view of an electrically heated smoking article according to an embodiment. The electrically heated smoking article according to the present embodiment includes a filter layer 100, which is a mouth filter, on an upper side, a hollow tube layer 200 stacked at a lower end of the filter layer 100, an aerosol-forming substrate layer 300 stacked at a lower end of the hollow tube layer 200 and including a mixture of a solid moisture absorbent 300*a* and a liquid aerosol-forming substrate capsule 1, and a wrapping portion 500 surrounding the filter layer 100, the hollow tube layer 200, and the aerosol-forming substrate layer 300 to maintain a corresponding stack structure thereof. The filter layer 100, the hollow tube layer 200, and the aerosol-forming substrate layer 300 are sequentially stacked in a vertical direction.

The filter layer 100 is a filter serving as a mouthpiece and serves to allow an aerosol to pass therethrough and prevent a liquid inflow. The filter layer 100 may be formed of pulp and may have a cylindrical or tube shape. The filter layer may be formed of materials, such as cellulose acetate, paper, polypropylene (PP), and polylactic acid (PLA). Meanwhile, the filter layer 100 may include a flavoring ingredient, thereby improving improve user satisfaction. Flavoring ingredients may include, for example, licorice, sucrose, fructose syrup, iso-sweeteners, cocoa, lavender, cinnamon, cardamom, celery, fenugreek, cascarilla, sandalwood, bergamot, geranium, honey essence, rose oil, vanilla, lemon oil, orange oil, mint oil, caraway, cognac, jasmine, chamomile, menthol, ylang-ylang, sage, spearmint, ginger, coriander, coffee, and the like.

The hollow tube layer 200 includes a hollow 220 extending in the vertical direction to provide a movement passage of the aerosol. The hollow tube layer 200 may include PLA to lower a temperature of the aerosol to prevent the user from getting burned when inhaling the aerosol. The hollow tube layer 200 may be formed of cellulose acetate, and the hollow tube layer 200 functioning as a cooling structure may be formed of pure polylactic acid or a combination of other degradable polymers and polylactic acid.

The aerosol-forming substrate layer 300 includes the solid moisture absorbent 300*a*. The solid moisture absorbent 300*a* may be a solid material that may include and fix the liquid aerosol-forming substrate capsule 1. Preferably, the solid moisture absorbent 300*a* is a solid material capable of absorbing at least a portion of a liquid aerosol-forming substrate flowing out of the liquid aerosol-forming substrate capsule 1.

For example, the solid moisture absorbent 300*a* may be formed by crumpling, folding, or rolling pulp or fabric including pulp to have a cylinder or column shape or by working pulp or fabric including pulp to have a cylinder or column shape, may be formed by crumpling or rolling cotton woven fabric or non-woven fabric to have a cylinder shape or by working cotton woven fabric or non-woven fabric to have a cylinder shape, or may be formed by crumpling or rolling a woven fabric or non-woven fabric of bamboo fiber to have a cylinder shape or by working the woven fabric or non-woven fabric of bamboo fiber to have a cylinder shape.

According to embodiments, the solid moisture absorbent 300*a* may be a solid aerosol-forming substrate. The solid aerosol-forming substrate may include cut tobacco leaves or leaf tobacco substrates. The solid aerosol-forming substrate may include solid materials based on tobacco raw materials, such as reconstituted tobacco, cut tobacco leaves, and the like. In an embodiment the solid aerosol-forming substrate may be a corrugated reconstituted tobacco sheet. The reconstituted tobacco sheet may be rolled, folded, compressed, or shrunken in a direction substantially transverse to a cylinder axis to be corrugated. The degree of porosity may be determined by adjusting an interval between the valleys of the corrugated reconstituted tobacco sheet.

In another embodiment the solid aerosol-forming substrate may be cut tobacco leaves. Here, the cut tobacco leaves may be produced by shredding a tobacco sheet (or a slurry reconstituted tobacco sheet). In addition, the solid aerosol-forming substrate may be formed by combining a plurality of tobacco strands in the same direction (parallel direction) or randomly. Specifically, the solid aerosol-forming substrate is formed by combining a plurality of tobacco strands, and a plurality of longitudinal channels through which an aerosol may pass may be formed. At this time, depending on the size and arrangement of the tobacco strands, the longitudinal channels may be uniform or non-uniform.

Alternatively, the solid moisture absorbent 300*a* may be in a state of absorbing an aerosol medium generating an aerosol by heating. The aerosol medium absorbed by the solid moisture absorbent 300*a* may be liquid or gel at room temperature. The aerosol medium may include at least glycerin for generating an aerosol. In addition, the gel-phase aerosol medium may further include a thickener for maintaining the gel phase.

In addition, the aerosol-forming substrate layer 300 includes the liquid aerosol-forming substrate capsule 1 in the form of a capsule accommodating the liquid aerosol-forming substrate therein. The liquid aerosol-forming substrate includes at least one material selected from the group consisting of glycerin, propylene glycol, nicotine, perfume, caffeine, water, cypress water, nutrient tonic, and cannabinoids. In addition, the liquid aerosol-forming substrate may further include a flavoring agent that modifies or adds to the taste or aroma characteristics of the aerosol discharged.

Based on the embodiments described above, the electrically heated smoking article of the embodiments may be inserted into a predetermined aerosol generating device so that the aerosol-forming substrate layer 300 may be heated, thereby generating an aerosol from the liquid aerosol-forming substrate flowing out of the liquid aerosol-forming substrate capsule 1. Also, according to embodiments, the solid aerosol-forming substrate or the solid moisture absorbent 300*a* that absorbs the aerosol medium may be heated to generate an aerosol. Thus, a user may inhale aerosols from a single source or from multiple sources using the electrically heated smoking articles of the embodiments.

Figure 2:
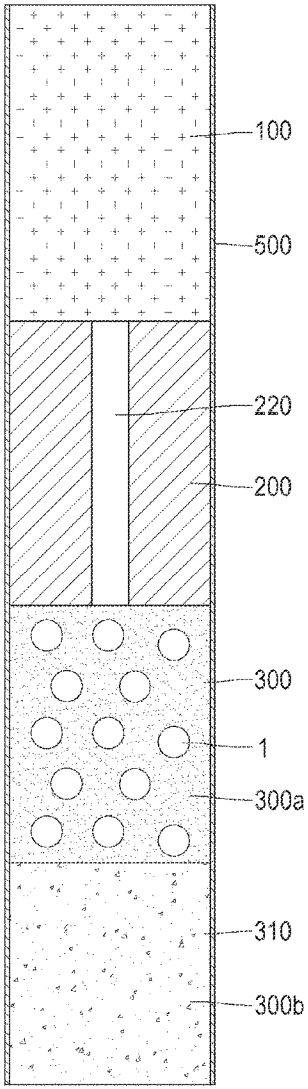
FIG. 2 is a schematic cross-sectional view of an electrically heated smoking article according to another embodiment.

FIG. 2 is a schematic cross-sectional view of an electrically heated smoking article according to another embodiment. The electrically heated smoking article in the present embodiment further includes a second aerosol-forming substrate layer 310 including a solid aerosol-forming substrate 300*b*. Here, the aerosol-forming substrate layer 300 including the liquid aerosol-forming substrate capsule 1 described above with reference to FIG. 1 may be referred to as a first aerosol-forming substrate layer. As long as the first aerosol-forming substrate layer 300 and the second aerosol-forming substrate layer 310 are stacked below the hollow tube layer 200, the first aerosol-forming substrate layer and the second aerosol-forming substrate layer may be interchanged in stacking order thereof. The user may inhale aerosols from a wider variety of sources by using the electrically heated smoking articles of the present embodiment.

Figure 3:
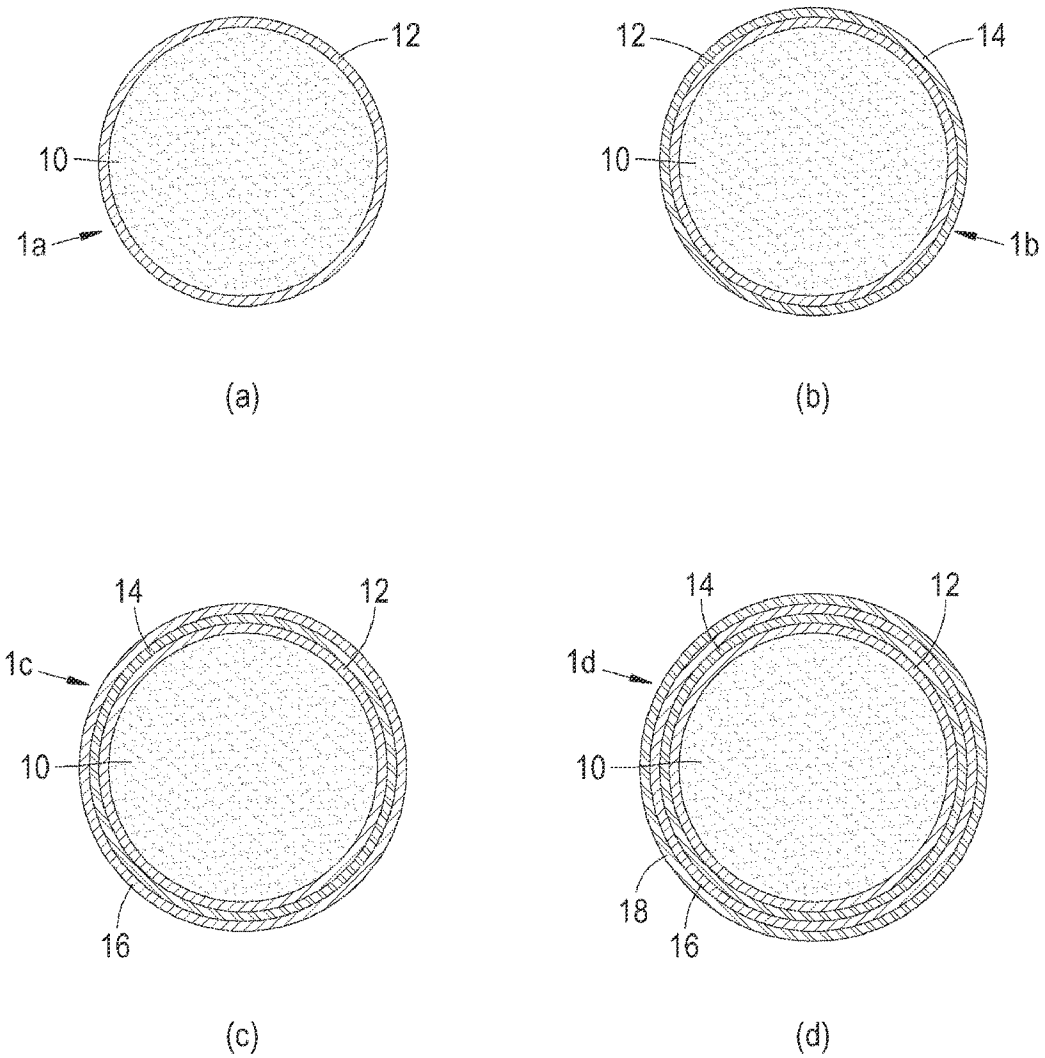
FIG. 3 is a schematic view of embodiments of a liquid aerosol-forming substrate capsule included in an electrically heated smoking article according to an embodiment.

FIG. 3 is a schematic diagram of embodiments 1*a*, 1*b*, 1*c*, and 1*d* of the liquid aerosol-forming substrate capsule 1 included in the electrically heated smoking article according to an embodiment, expressed in a vertical cross-sectional view.

The capsule 1*a* according to a first embodiment in (a) of FIG. 3 includes a spherical liquid aerosol-forming substrate 10 at the center and a first emulsifier layer 12 completely surrounding the entire surface of the liquid aerosol-forming substrate 10. The liquid aerosol-forming substrate 10 is a hydrophilic material, and the first emulsifier layer 12 is formed of a hydrophobic material, so that the first emulsifier layer 12 is not mixed with the liquid aerosol-forming substrate 10. The first emulsifier layer 12 having hydrophobic properties includes a first emulsifier including one or more materials selected from the group consisting of sorbitan monopalmitate, glycerol monostearate, sorbitan monostearate, sorbitan monooleate, glycerol monolaurate, propylene glycol monoester, glycerol monooleate, polyglycerol polyricinoleate, and soy lecithin.

The capsule 1*a* according to the first embodiment is formed by a water-in-oil emulsion method. For example, the method includes a first operation of mixing the liquid aerosol-forming substrate 10 with the first emulsifier, and a second operation of dissolving oil in the first emulsifier in the first operation. In the first operation and the second operation, the liquid phase may be stirred at each operation, or the first operation and the second operation may be combined for stirring. In addition, a method of dispersing particles of the first emulsifier by using a sonicator when the first emulsifier is added may be included. In addition, stirring and ultrasonic spraying operations may be selectively used for each operation. By this process, the structure of the capsule 1*a* according to the first embodiment in (a) of FIG. 3 is formed.

A capsule 1*b* according to a second embodiment in (b) of FIG. 3 includes the capsule 1*a* of the first embodiment and a first coating material layer 14 applied to the entire surface of the capsule 1*a* of the first embodiment.

The first coating material layer 14 is formed of a first coating material having hydrophobic properties in addition to the emulsifier used in the first emulsifier layer 12 to maintain a capsule state.

The first coating material has hydrophobic properties, and includes one or more materials selected from the group consisting of palm oil, beeswax, candelilla wax, coconut oil, cinnamon bark oil, and soybean oil, hydrophobic polymers, and alcohols.

A capsule 1*c* according to a third embodiment in (c) of FIG. 3 includes the capsule 1*b* of the second embodiment and additionally a second emulsifier layer 16 surrounding the entire surface (that is, the first coating material layer 14) of the capsule 1*b* of the second embodiment.

The second emulsifier layer 16 is formed of a hydrophilic material, and the second emulsifier layer 16 is formed of a second emulsifier including one or more materials selected from the group consisting of polyoxyethylene sorbitan monostearate, polyglycerol monooleate, polyoxyethylene sorbitan monolaurate, polyoxyethylene sorbitan monooleate, polyoxyethylene sorbitan monopalmitate, and sucrose stearate.

A capsule 1*d* according to a fourth embodiment in (d) of FIG. 3 includes the capsule 1*c* of the third embodiment and additionally a second coating material layer 18 surrounding the entire surface (that is, the second emulsifier layer 16) of the capsule 1*c* of the third embodiment.

The second coating material constituting the second coating material layer 18 has hydrophilicity and includes one or more materials selected from the group consisting of vegetable, algae, or bacterial polysaccharides, hydrophilic proteins, hydrophilic polymers, and alcohols.

Each of the capsules 1*b*, 1*c*, and 1*d* in (b), (c) and (d) of FIG. 3 may be manufactured in a manner that is the same as or similar to that of a manufacturing process of the capsule 1*a* described above.

The liquid aerosol-forming substrate capsule according to an embodiment may protect the liquid aerosol-forming substrate therein and prevent the liquid aerosol-forming substrate therein from drying out.

The electrically heated smoking article according to an embodiment is inserted into an aerosol generating device equipped with a heating unit and heated by the heating unit. During heating by the heating unit, the solid aerosol-forming substrate and the liquid aerosol-forming substrate capsule are heated, and as the capsule of the liquid aerosol-forming substrate capsule is destroyed, the liquid aerosol-forming substrate is heated to be changed into a gaseous aerosol and discharged.

Although a few aspects of the present disclosure have been shown and described, it would be appreciated by those skilled in the art that changes may be made in the aspects without departing from the principles and spirit of the invention, the scope of which is defined in the claims and their equivalents.

What is claimed is:

1. An electrically heated smoking article, comprising:

a filter layer;

a hollow tube layer stacked at a lower end of the filter layer;

an aerosol-forming substrate layer stacked below the hollow tube layer and including a mixture of a solid moisture absorbent and a liquid aerosol-forming substrate capsule; and a wrapping portion surrounding the filter layer, the hollow tube layer, and the aerosol-forming substrate layer to maintain a stack structure, wherein the liquid aerosol-forming substrate capsule includes a liquid aerosol-forming substrate at a center, a first emulsifier-formed layer completely surrounding the liquid aerosol-forming substrate, a first coating material layer covering a surface of the first emulsifier-formed layer, and a hydrophilic second emulsifier-formed layer surrounding the entire first coating material layer, wherein the second emulsifier-formed layer is formed of a second emulsifier including one or more materials selected from the group consisting of polyoxyethylene sorbitan monostearate, polyglycerol monooleate, polyoxyethylene sorbitan monolaurate, polyoxyethylene sorbitan monooleate, polyoxyethylene sorbitan monopalmitate, and sucrose stearate.

2. The electrically heated smoking article of claim 1, wherein the liquid aerosol-forming substrate is a hydrophilic material, the first emulsifier-formed layer is a hydrophobic material, and the first coating material layer is a hydrophobic material.

3. The electrically heated smoking article of claim 2, wherein the first emulsifier-formed layer includes a first emulsifier including one or more materials selected from the group consisting of sorbitan monopalmitate, glycerol monostearate, sorbitan monostearate, sorbitan monooleate, glycerol monolaurate, propylene glycol monoester, glycerol monooleate, polyglycerol polyricinoleate, and soy lecithin.

4. The electrically heated smoking article of claim 2, wherein the first coating material layer includes one or more materials selected from the group consisting of palm oil, beeswax, candelilla wax, coconut oil, cinnamon bark oil, soybean oil, hydrophobic polymers, and alcohols.

5. The electrically heated smoking article of claim 1, wherein the liquid aerosol-forming substrate capsule includes a hydrophilic second coating material layer surrounding the entire second emulsifier-formed layer.

6. The electrically heated smoking article of claim 5, wherein the second coating material layer is formed of one or more materials selected from the group consisting of vegetable, algae, or bacterial polysaccharide, hydrophilic protein, hydrophilic polymer, and alcohol.

7. The electrically heated smoking article of claim 1, wherein the liquid aerosol-forming substrate includes one or more materials selected from the group consisting of glycerin, propylene glycol, nicotine, perfume, caffeine, water, cypress water, nutrient tonic, and cannabinoids.

8. The electrically heated smoking article of claim 1, wherein the solid moisture absorbent is a solid aerosol-forming substrate.

9. The electrically heated smoking article of claim 1, further comprising a second aerosol-forming substrate layer stacked below the hollow tube layer and including a solid aerosol-forming substrate.

* * * * *